US005134258A

United States Patent [19]

Carrodus

[11] Patent Number: 5,134,258

[45] Date of Patent: Jul. 28, 1992

[54] MANUAL-OPERATED CIRCUIT BREAKER WITH SLIDING ACTION FOR CONTROL AND SETTING

[75] Inventor: Melvin A. Carrodus, Brighton Township, Beaver County, Pa.

[73] Assignee: Westinghouse Electric Corp., Pittsburgh, Pa.

[21] Appl. No.: 666,320

[22] Filed: Mar. 8, 1991

[51] Int. Cl.[5] ..... H01H 3/20; H01H 3/00

[52] U.S. Cl. ..... 200/330; 200/329; 200/331

[58] Field of Search ..... 200/330, 331, 338, 547, 200/43.14, 43.19, 43.21, 401, 329, 332, 332.1, 332.2, 43.04, 43.07, 332, 335, 336, 339; 74/89, 544

[56] References Cited

U.S. PATENT DOCUMENTS

| | | | |
|---|---|---|---|
| 3,077,789 | 2/1963 | Lashmutt | 200/331 X |
| 3,242,298 | 3/1966 | Miller | 200/338 |
| 3,408,466 | 10/1968 | Palmer | 200/43.15 |
| 3,475,710 | 10/1969 | Ellsworth et al. | 337/55 |
| 4,266,210 | 5/1981 | Mrenna et al. | 335/201 |
| 4,886,946 | 12/1989 | Franks, Jr. | 200/329 |
| 4,914,265 | 4/1990 | Mongeau | 200/332 |

*Primary Examiner*—Henry J. Recla
*Assistant Examiner*—David J. Walczak
*Attorney, Agent, or Firm*—M. J. Moran

[57] ABSTRACT

The handle of a circuit breaker is controlled manually by sliding a linkage member right, or left, upon a flat surface of the housing of the circuit breaker. The linkage member is at one end pivotally attached through a knurled pin to the handle and, at the other end, a handhold portion is provided with a recess admitting a finger, or thumb, to push or pull the linkage member and actuate the circuit breaker through its handle.

5 Claims, 4 Drawing Sheets

MANUAL-OPERATED CIRCUIT BREAKER WITH SLIDING ACTION FOR CONTROL AND SETTING

FIELD OF THE INVENTION

The invention relates to circuit breakers in general and, more particularly, to manually operated circuit breakers.

BACKGROUND OF THE INVENTION

Manually operated circuit breakers are generally provided with a handle protruding outside of the breaker housing, the handle being actuated by an operator for rotation from a closed to an open position. The circuit breakers are usually placed side by side within a cabinet having a panel, the handles being well exposed on the face of the panel and made accessible for control wherever needed so that the status of any individual circuit breakers be at all time visible, before or after being set ON, or OFF.

Instead of placing the circuit breakers so that either up or down positions of the handles are selectively obtained by rotation of the handles in a vertical plane, it is also possible to have the circuit breakers disposed horizontally, whereby the handles will appear as having been moved from the right to the left, or conversely, for the same goal, namely to place any selected circuit breaker in a status position wherein its electrical contacts are either OPEN (status OFF), or CLOSED (status ON).

SUMMARY OF THE INVENTION

According to the present invention, it is now proposed to individually control the handles indirectly through a sliding member which will engage a corresponding handle whenever actuated by motion to and fro in a plane parallel to the cabinet panel.

This is implemented by providing a linkage member having a cavity for capturing the handle and a handhold to be held by the operator. In this regard, advantage is taken of a flat surface, existing on the top of the circuit breaker housing, upon which the linkage member can rest and slide, and of a transversal opening in the handle allowing a pin to be passed for fixing the linkage member and to serve as a pivot when the handle is in motion. The cavity has opposite inner surfaces at a distance from one another representing the distance existing between the extreme operative positions of the handle, each inner surface forming an edge designed to engage a corresponding side of the handle. The handhold portion of the linkage member is provided with a recess on the upper side thereof which is adapted to receive the finger or the thumb of the operator. Preferably, such recess is provided with inner slip resistant means, such as closely parallel transversal ridges, or a layer of rough surface material. The dimensions of the upper face of the circuit breaker casing are matching those of the linkage member. The recess of the handhold portion permits an easy access with a finger or a thumb. The linkage member is very easily mounted on the flat surface of the circuit breaker casing with which it becomes perfectly integrated, the handle being totally captured inside. Nevertheless, this cavity of the linkage member, which encompasses the handle in its two extreme operative positions, is made open at both ends, one entered by the handle when mounted, the other serving as a window to allow the handle to be seen, thereby making the circuit breaker status directly visible. The transversal hole of the handle at two ends matches opposite transversal holes in the linkage member. However, the latter holes are given a vertically elongated shape so that they possess a play that the pin can follow during the arcuate trajectory of the handle in motion which otherwise would tend to pull upward the linkage member. Accordingly, the linkage member will remain at rest flush with the flat surface of the casing.

The linkage member is preferably molded, whereby so many can be installed on a cabinet panel and become integrated with the circuit breakers already in place for operation. The design is easily dimensioned, so as to permit a direct installation in closed panels, as well as in exposed ones. Effective handling of the circuit breakers, through sliding linkage members according to the present invention, is combined with enhanced appearance for the exposed panels, both features being obtained with a simple arrangement and employing a cost effective approach.

DETAILED DESCRIPTION OF THE INVENTION

Figure 1:
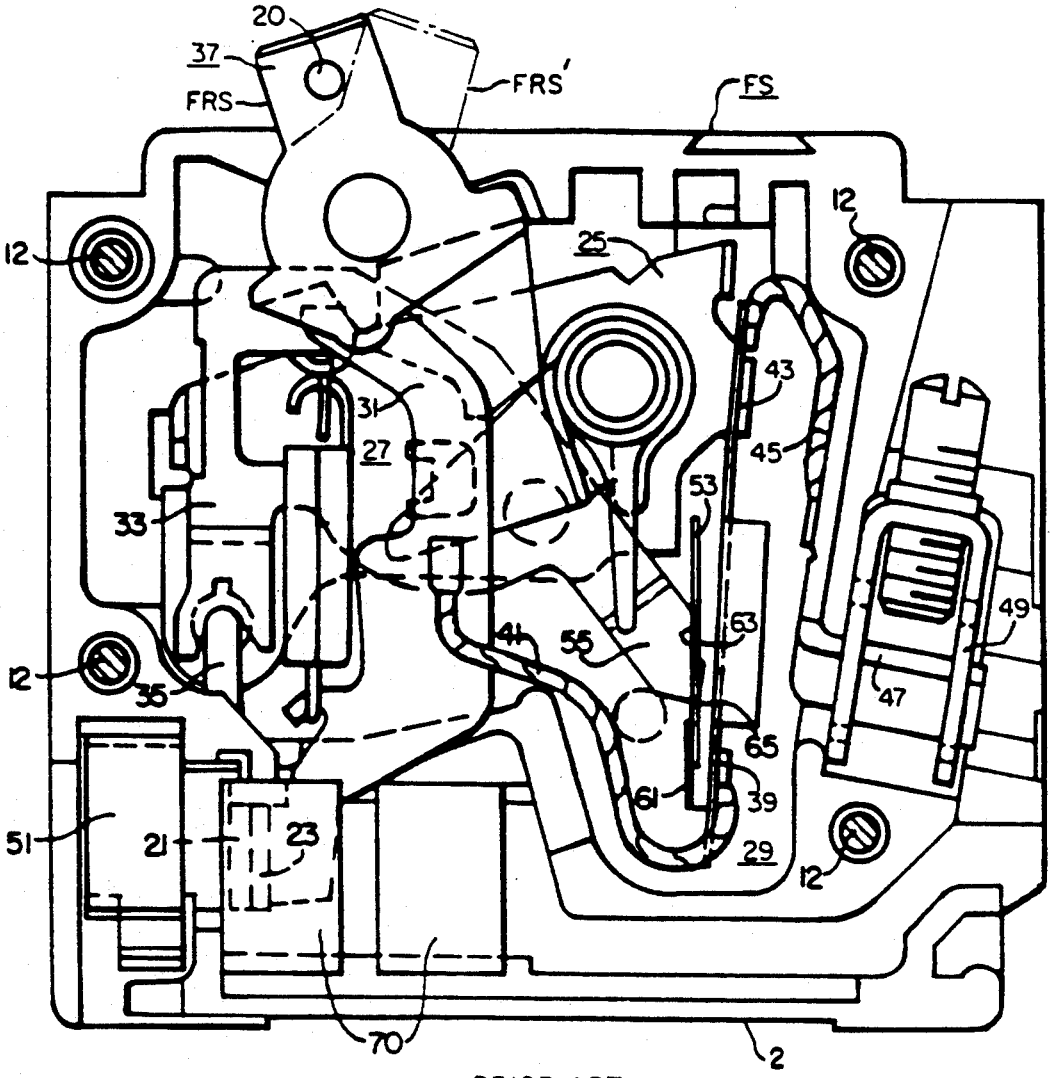
PRIOR ART FIG. 1.
FIG. 1 is an inner and side view of a one-pole circuit breaker of the prior art with its housing opened on one side.

FIG. 1, taken from U.S. Pat. No. 4,266,210, is a side view of a circuit breaker structure used according to the preferred embodiment of the invention. It shows a one-pole circuit breaker with its handle 37 protruding outside of the housing 2. U.S. Pat. No. 4,266,210 is incorporated-by-reference in order to provide a full description of the internal parts of the circuit breaker, that it be the operating mechanism 27 (including a contact arm 31 used for moving the movable contact 23 away from the stationary contact 21, in a conventional manner), or the housing (shown opened, by its four freed fixing pins 12, and having a flat surface FS out of which the handle 37 is shown protruding). Handle 37 is shown in one of two opposite positions (ON and OFF) with the front side FRS inclined at an angle toward the upper flat surface FS of the housing 2. The opposite position with its front side FRS' is shown in dotted line.

Figure 2C:
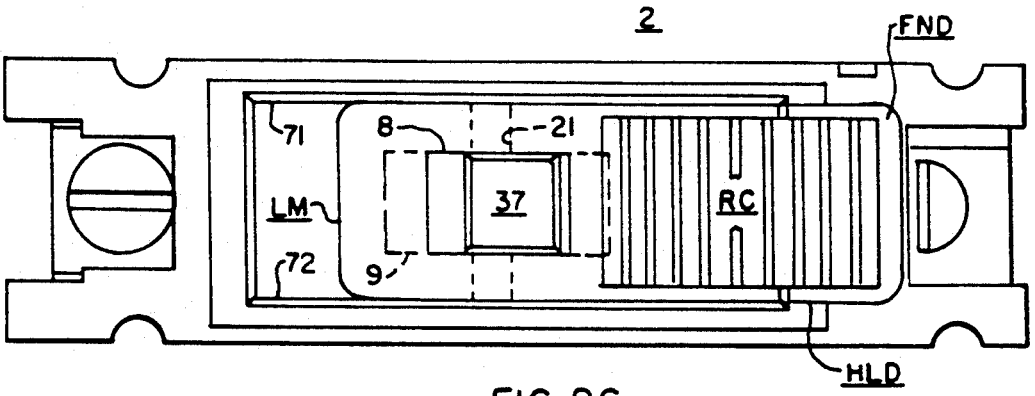
FIGS. 2A, 2B and 2C are the front side and top views, respectively, of the closed-up one-pole circuit breaker housing of FIG. 1, shown embodying a linkage member according to the present invention.
Figure 2A:
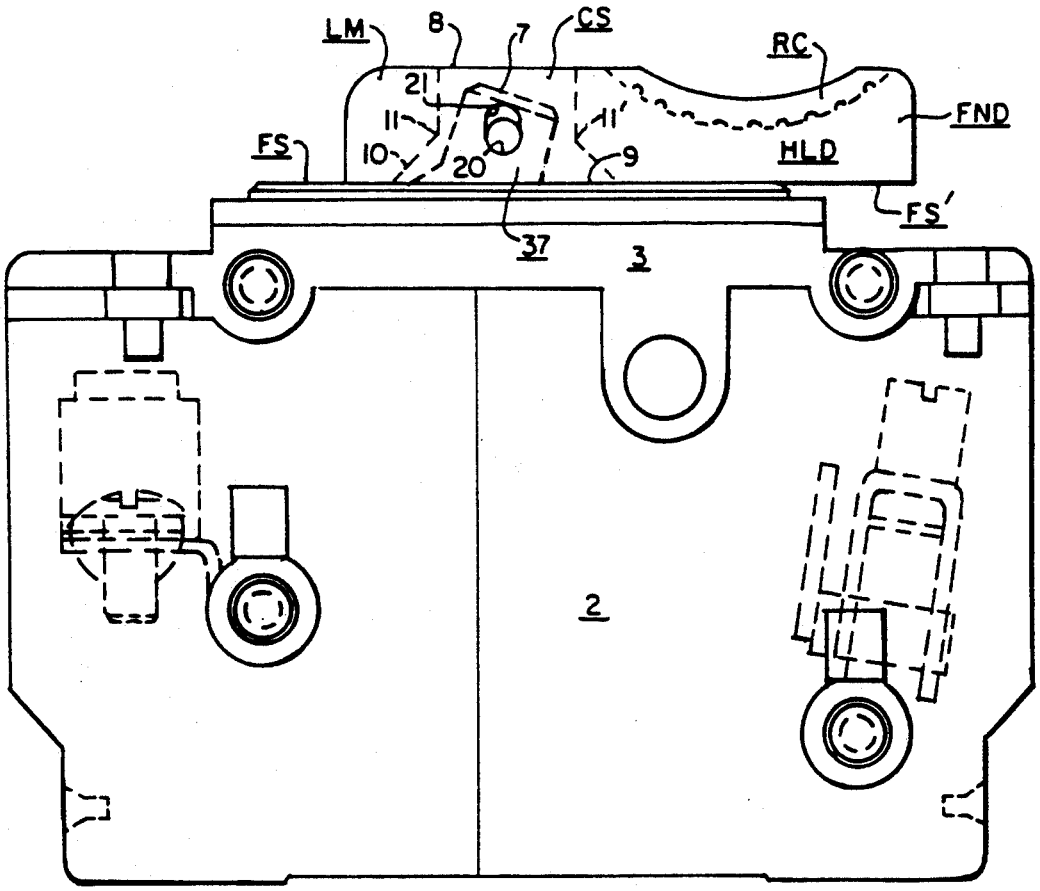
Figure 2B:
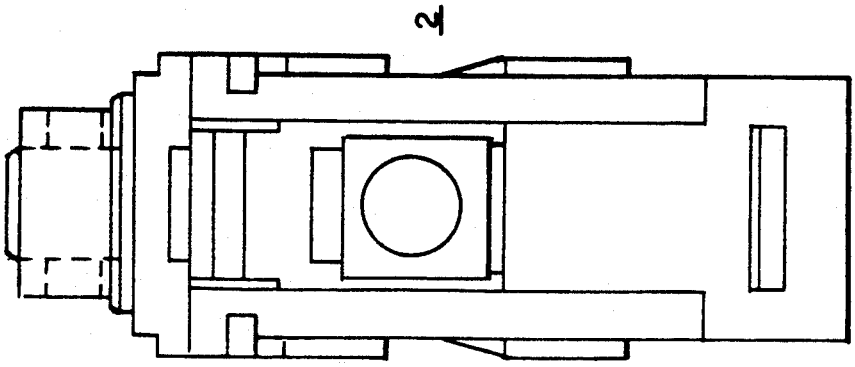

As shown in FIGS. 2A to 2C, according to the preferred embodiment of the present invention, upon the flat surface FS of the circuit breaker of FIG. 1 is placed and mounted flush thereon, a linkage member LM having underneath a flat surface FS' and provided at one end with a cavity CS, specially designed so as to contain the protruding portion of the handle 37, whether it be in its open, or in its closed position. At its other end, the linkage member possesses an extension which serves as a handhold portion HLD to handle the linkage member by sliding it along the flat surface FS so as to push, or pull, the handle into, or out of, its closed position. Such handhold portion has a recess RC which permits the insertion of a finger, or a thumb, while the front end FND of the linkage member allows the operator to grasp with it the linkage member and to actuate it slidably, forward or backward.

The cavity CS has a squared section (shown in FIG. 2C) open at both ends 8 and 9. Upward, end 8 allows to see, by the position of the upper face 7 of the handle 37 how it actually stands, OPEN or CLOSED, depending upon on which side it has been stably shifted by rotation of the contact arm. Downward, is an opening 9 in the flat surface FS' which is larger than the upper opening 8. From two opposite break lines 11 and 11', the square section is widening along inclined faces 10 and 10' reaching the opening 9. This widening accommodates the round base of the handle 37. Thus, the sectional difference within cavity CS establishes at the junction opposite inner edges 11 and 11'. The handle has a circular transversal hole 20. Aligned with it, the linkage member has a somewhat larger hole 21 disposed laterally across the sidewalls of the cavity CS, on both sides. When it is pulled to the right, the linkage member will engage by its inner edge 11 the arm 37 and cause it to be moved to the right, the final position being shown in FIG. 2A. Conversely, when pushing linkage member LM to the left, the other edge 11' will engage handle 37 and cause the circuit breaker to adopt the opposite position. A knurled pin 100 is passed across the holes 20 and 21 in order to hold together the linkage member and the handle, while maintaining the handle inside cavity CS. The lateral hole 21 of the linkage member is somewhat larger than the handle transversal hole 20 and elongated in a direction normal to the flat surface FS'. This has been chosen in order to allow the pin, bound by the handle hole 20, to follow the arcuate trajectory imposed to it when the handle rotates from one position to the other. The two extreme circles defining hole 21 correspond to the two resulting extreme higher and lower positions of the pin in motion. Although, not shown, the pin is knurled to hold it in place.

As shown in FIGS. 2B and 2C, the cross dimensions of the linkage member are within the limits 71 and 72 of the flat surface FS of the housing of the circuit breaker.

Figure 3:
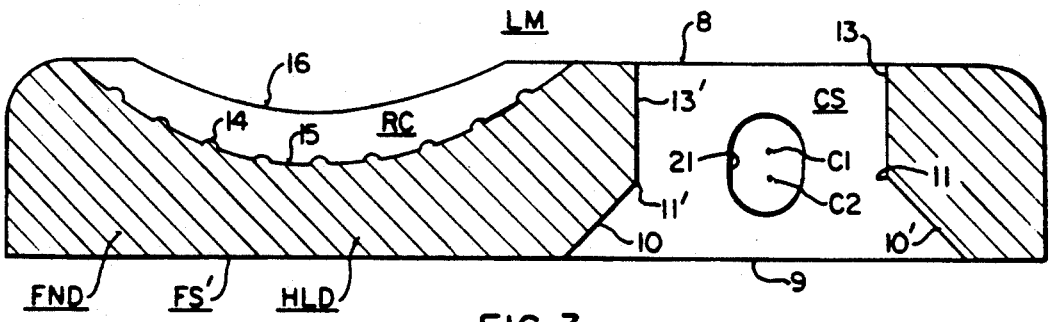
FIG. 3 is a cross-sectional view of the in situ linkage member of FIGS. 2A to 2C.

FIG. 3 is a cross-sectional view of the linkage member LM taken in the middle plane thereof. The recess RC appears to be defined by a sidewall having a circular edge 16 and by a cylindrical bottom surface 15. The latter is shown having a series of equally spaced ridges 14 of minimal height, just enough to create a braking barrier against sliding for a finger or a thumb applying a parallel forces against the curved surface 15, whether it be to the right, or to the left. Cavity CS appears with its upper opening 8 and its wider lower opening 9 due to the opposite widening inclined walls 10 and 10'. The narrower upper portion defined by opposite vertical walls 13 and 13' forms a squared column ending upwardly with the opening 8. Laterally are two inner holes 21, both as shown FIG. 3. The inner holes have opposite circular ends of respective centers C1 and C2. The vertical distance between centers C1 and C2 defines the play allowed in relation to the arcuate trajectory of the transversal pin moving with the handle 37.

Figure 4C:
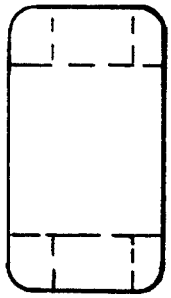
FIGS. 4A, 4B and 4C are front and top and side views of the linkage member of FIG. 3.
Figure 4A:
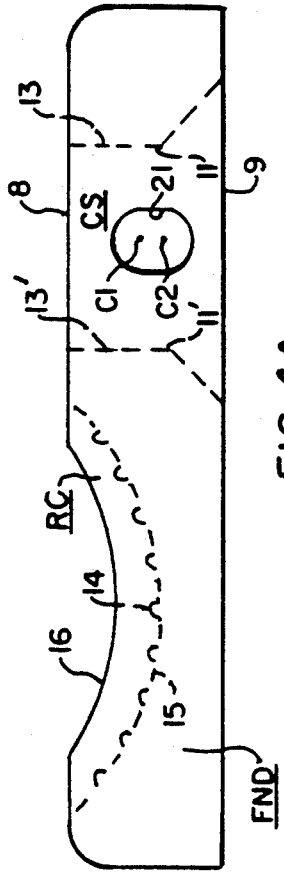
Figure 4B:
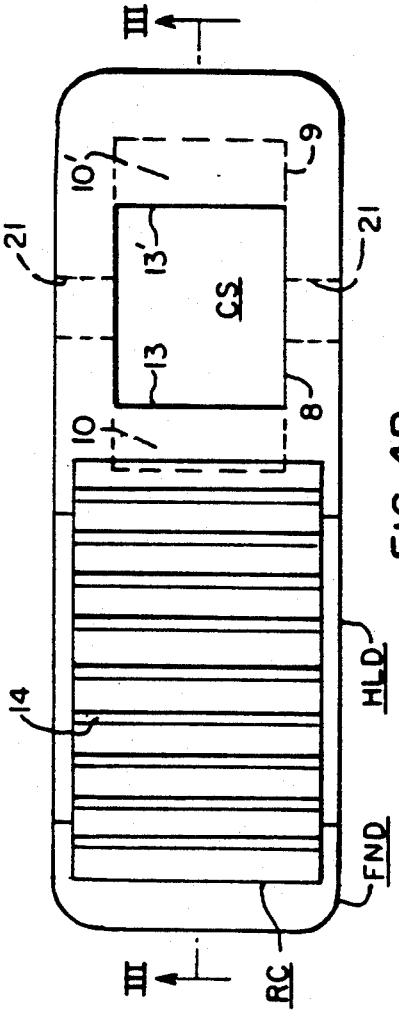

FIGS. 4A, 4B and 4C are front, top and side views of the linkage member LM, with the same specific dimensions as in FIG. 3 being given as an example for the preferred embodiment.

These dimensions are summarized in the following table:

TABLE

| | (all Dimensions in Inches) |
|---|---|
| LM | length 1.843 width .625 height .344 |
| RC | bottom surface .625 radius |
| | sidewall edge .625 radius |
| | from upper surface to peak depth of |
| | bottom edge: .188 |
| CS | upper opening: .376 × .440 |
| | lower opening: .376 × .706 |
| | radius from centers C1 and C2: .066 |
| | distance between C1 and C2: .045 |
| | vertical depth of edges 11 and 11': |
| | .204 and .218, respectively |
| | height of ridges 14: .016 |
| | distance between ridges 14: .098 (center to center) |
| Handle 37 | (front side in stable position) |
| | highest level above surface FS of front side: .344 |
| | distance between opposite front sides: .374 |

Several circuit breakers like the one shown in FIG. 1 may be placed side by side in a cabinet, their upper surfaces appearing on a front panel with the handles 37 regularly placed for an easy control and observation of their status by the operator. According to the present invention, so many linkage members such as earlier described will be placed on top of such front panel, and such linkage member may have been designed with a height permitting the panel to be closed.

Variations from the preferred embodiment just described can be made in accordance with the present invention. For instance, instead of using ridges as shown at 14, it is possible to apply on the bottom surface 14 of the recess RC a layer of rough surface which will prevent the operator's finger, or thumb, from gliding when an attempt to slide the linkage member and control the circuit breaker handle 37 is effected.

Figure 5A:
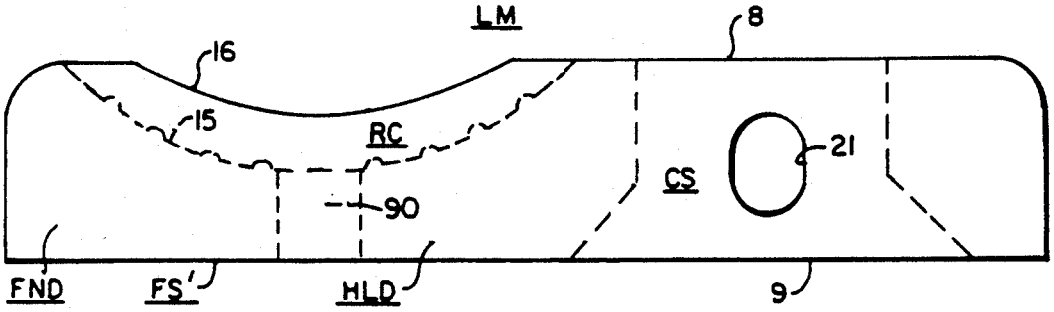
FIGS. 5A and 5B are illustrative of another embodiment of the invention.
Figure 5B:
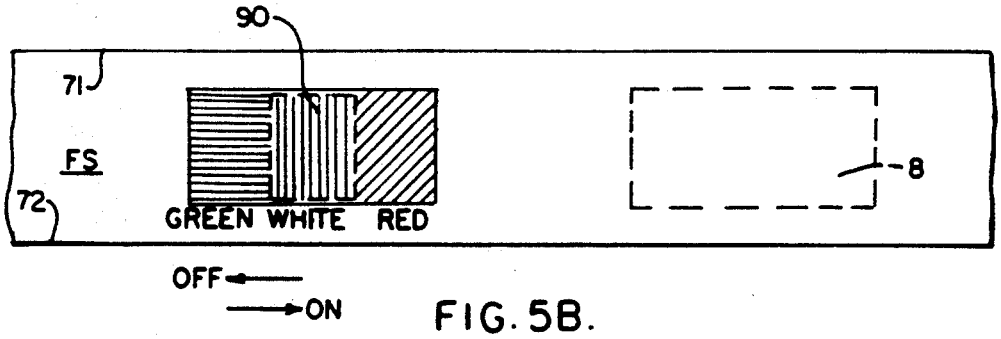

FIGS. 5A and 5B are related to another embodiment of the invention, an opening 90 has been provided at the bottom and in the center of the recessed portion of the handhold HLD in order to expose the upper surface FS of the circuit breaker holding as the linkage member LM is resting upon it in position ON or OFF, or TRIPPED for the circuit breaker. As generally known, between the opposite positions ON and OFF taken by the handle 37, there is an intermediary position resulting from an internal automatic OFF switching of the movable contact, called tripping. As shown in FIG. 5B, between the opposite lines 71 and 72, the upper surface FS is colored according to an international code in areas corresponding to these three successive handle positions: red for the ON position (to the right in FIG. 5B), green for the OFF position (to the left in FIG. 5B) and white for TRIPPED (in between). The frame of the window 90 projected on the surface FS has been shown in dotted line. For the sake of clarity, the projection of the opening CS under the opening 8 has also been shown in dotted line.

Other changes or modifications can be made without ceasing to be within the scope of the present invention.

I claim:

1. In a circuit breaker enclosed within a housing having an upper flat surface provided with an opening thereon, the circuit breaker having a rotatably mounted handle protruding through said opening for motion between extreme ON and OFF positions, comprising:

an elongated linkage member having a lower flat surface and being at one end pivotally connected to said handle, said linkage member being mounted upon said housing so as to rest upon said upper flat surface through said lower flat surface, a handhold portion being provided at said other end for manually actuating said handle from one position to the other by sliding between said upper and lower flat surfaces; said handhold portion having a first recess with transversely disposed ridges; said linkage member having at said one end a second recess for receiving said handle and for allowing motion thereof between said extreme positions; said second recess having a lower opening for allowing said handle to enter therein; and an upper opening for allowing upper movement of said handle therein; said handle having a transversal hole, and said second recess having side holes aligned with and larger than said handle hole, and a pin being passed through said holes to enable the handle to be pivotally engaged with said linkage member whereby sliding the linkage member along the upper flat surface of the housing will rotate the handle from one extreme position to the other.

2. The circuit breaker of claim 1, with said side holes encompassing the movement of said pin between said extreme positions of the handle.

3. The circuit breaker of claim 2, with said handhold recess having a window for making said housing upper flat surface visible therethrough;

4. The circuit breaker of claim 3, with said upper flat surface having in projection through said window a coded sign for indicating through linkage member positioning the circuit breaker adopted position.

5. The circuit breaker of claim 4, with said handle having a circuit breaker tripped position placed intermediary between said extreme handle positions, said coded sign including said tripped position.

* * * * *